US005977926A

United States Patent [19]

Gilger

[11] Patent Number: 5,977,926

[45] Date of Patent: Nov. 2, 1999

[54] MULTI-FOCUS REFLECTOR ANTENNA

[75] Inventor: L. Dwight Gilger, Torrance, Calif.

[73] Assignee: TRW Inc., Redondo Beach, Calif.

[21] Appl. No.: 09/150,798

[22] Filed: Sep. 10, 1998

[51] Int. Cl.[6] ..... H01Q 13/00; H01Q 21/00

[52] U.S. Cl. ..... 343/781 P; 343/836; 343/837

[58] Field of Search ..... 343/781 R, 781 P, 343/915, 912, 839, 835, 837, 756, 836, 779

[56] References Cited

U.S. PATENT DOCUMENTS

| | | | |
|---|---|---|---|
| 3,803,622 | 4/1974 | Thorton | 343/836 |
| 3,898,667 | 8/1975 | Raab | 343/756 |
| 4,232,322 | 11/1980 | Padova et al. | 343/781 R |

*Primary Examiner*—Don Wong
*Assistant Examiner*—Jennifer H. Malos
*Attorney, Agent, or Firm*—Michael S. Yatsko; Connie M. Thousand

[57] ABSTRACT

A multi-focus reflector antenna for providing a plurality of antenna patterns from a single reflector structure eliminates the need for multiple reflector antennas on a single spacecraft. The multi-focus reflector antenna includes a plurality of at least partially overlapping reflecting structures on a single support structure, each reflecting structure having a focal point and a focal axis. A plurality of RF signals radiate from the focal points, at least one of which passes through at least one of the plurality of reflecting structures and is incident upon another of the plurality of reflecting structures. The plurality of reflecting structures then direct the plurality of RF signals along the plurality of focal axis and generate a plurality of antenna patterns. The multi-focus reflector has applications in communications systems and more particularly, in satellite voice and data communications, and other RF type signals.

16 Claims, 4 Drawing Sheets

MULTI-FOCUS REFLECTOR ANTENNA

BACKGROUND OF THE INVENTION

1. Field of the Invention

The present invention relates to the field of reflector antennas, and more particularly, to a reflector antenna which includes a plurality of frequency selective or polarization sensitive structures to provide a plurality of antenna patterns from a single support structure.

2. Description of the Prior Art

Reflector antennas are frequently used on spacecrafts to provide communication links with the ground or other spacecrafts. A single spacecraft will typically house multiple antennas to provide multiple communication links. These multiple antennas on a single spacecraft typically operate at different frequencies or polarizations to lower crosstalk and interference between antennas.

One method of providing multiple frequencies and multiple communication capabilities on a single spacecraft is to provide multiple reflector antennas, one for each desired frequency of operation. Although this method provides good isolation between antennas, it requires a large amount of space on a spacecraft, is expensive and extracts a weight penalty.

A second method of providing multiple frequencies and multiple communication capabilities on a single spacecraft is to provide a single reflector antenna having multiple feeds, each feed radiating a separate RF frequency or polarization. One feed is placed at the focal point of the reflector while the other feeds are located as near the focal point as practical. This results in a loss of signal strength for the unfocused feeds and may require a larger reflector to compensate for the losses. A larger reflector requires more space on the spacecraft and provides an antenna pattern with a narrower beamwidth, which may be undesirable.

A third method of providing multiple frequencies and multiple communication capabilities on a single spacecraft is to utilize a frequency sensitive structure, also known as a dichroic structure, as the subreflector in a cassegrain type reflector antenna. A cassegrain type reflector antenna has a main reflector and a smaller subreflector. The dichroic subreflector is hyperbolic in shape and has two focal points, one located on each side of the subreflector. The subreflector is placed between the main reflector and the focal point of the main reflector with the convex side of the subreflector facing the main reflector. The focal point on the concave side of the subreflector is placed at the focal point of the main reflector and a first feed, radiating a first RF signal at a first frequency, is placed at this focal point. The dichroic subreflector is configured to pass the first RF signal through the subreflector such that the first RF signal will be incident on the main reflector and generate a first antenna pattern at a first frequency.

A second feed, radiating a second RF signal at a second frequency, is placed at the focal point on the convex side of the subreflector. The dichroic subreflector is configured to reflect the second RF signal and redirect it towards the main reflector such that the second RF signal will be incident on the main reflector and create a second antenna pattern at a second frequency. In this way, a single reflector can provide antenna patterns at two separate frequencies. This scheme, however, is limited to combining two antennas into a single structure. In addition, the size of the reflector typically determines the gain and beamwidth of the antenna pattern and the focal axis determines the location of the antenna pattern. Using a single main reflector with a dichroic subreflector typically results in the first and second antenna patterns having the same gain-beamwidth product and the same location which may be undesirable. A subreflector can also add a level of complexity to the antenna and provide antenna blockage that may be undesirable.

A need exists to have a single reflector apparatus with multiple focal points. This would allow a single spacecraft to carry the weight and expense of one reflector apparatus while having the ability to provide communication links with multiple communication stations or vehicles.

SUMMARY OF THE INVENTION

The aforementioned need in the prior art is satisfied by this invention, which provides a multi-focus reflector antenna. A multi-focus reflector antenna, in accord with the invention, comprises a support having a plurality of at least partially overlapping reflecting structures, each reflecting structure having a focal point and a focal axis. The antenna includes a plurality of radiating means one each of which is located at each of the focal points. The plurality of radiating means radiate a plurality of RF signals, at least one of which passes through at least one of the plurality of reflecting structures and is incident upon another of the plurality of reflecting structures. The plurality of reflecting structures then directs the plurality of RF signals along the plurality of focal axis and generates a plurality of antenna patterns.

The reflecting structures can be fixed or deployable and can be frequency selective or polarization sensitive.

DETAILED DESCRIPTION OF THE INVENTION

Figure 1:
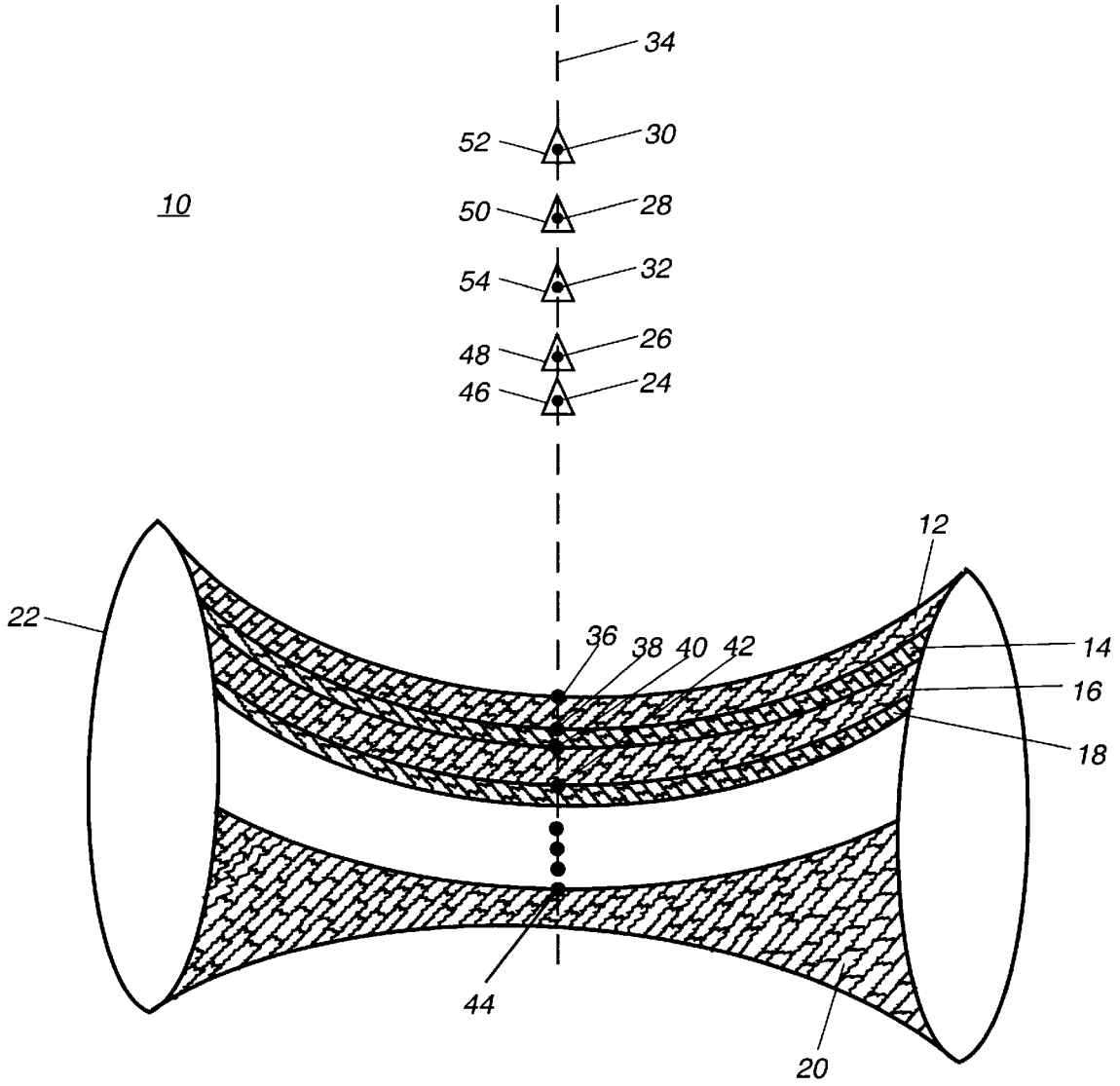
FIG. 1 is a side plane view of one embodiment of the invention.

Referring to FIG. 1, a multi-focus reflector 10 for providing multiple antenna patterns from a single support structure is illustrated. In particular, in the present invention, multiple reflecting structures 12–20, each being a frequency selective or polarization sensitive structure, are overlaid allowing the plurality of reflecting structures 12–20 to be located on a single support structure 22. The curvature and shape of each reflecting structure 12–20 defines the focal point of that reflecting structure. For the embodiment shown in FIG. 1, the first reflecting structure 12 has a first focal point 24, the second reflecting structure 14 has a second focal point 26, the third reflecting structure 16 has a third focal point 28, the fourth reflecting structure 18 has a fourth focal point 30; and, nth reflecting structure 20 has an nth focal point 32.

The focal axis of a reflecting structure determines the direction and location of the antenna pattern generated by that reflecting structure. A focal axis of a reflecting structure is defined by an imaginary line passing through the center of the reflecting structure and extending through the focal point of that reflecting structure. The focal axis of the first reflecting structure 12 would be defined by an imaginary line 34 passing through the center 36 of the first reflecting structure 12 and extending through the first focal point 24. For the embodiment of the invention shown in FIG. 1, the centers 36–44 and the focal points 24–32 all lie along the same imaginary line 34; thus, for this embodiment, all reflecting structures 12–20 have the same focal axis 34.

Figure 2:
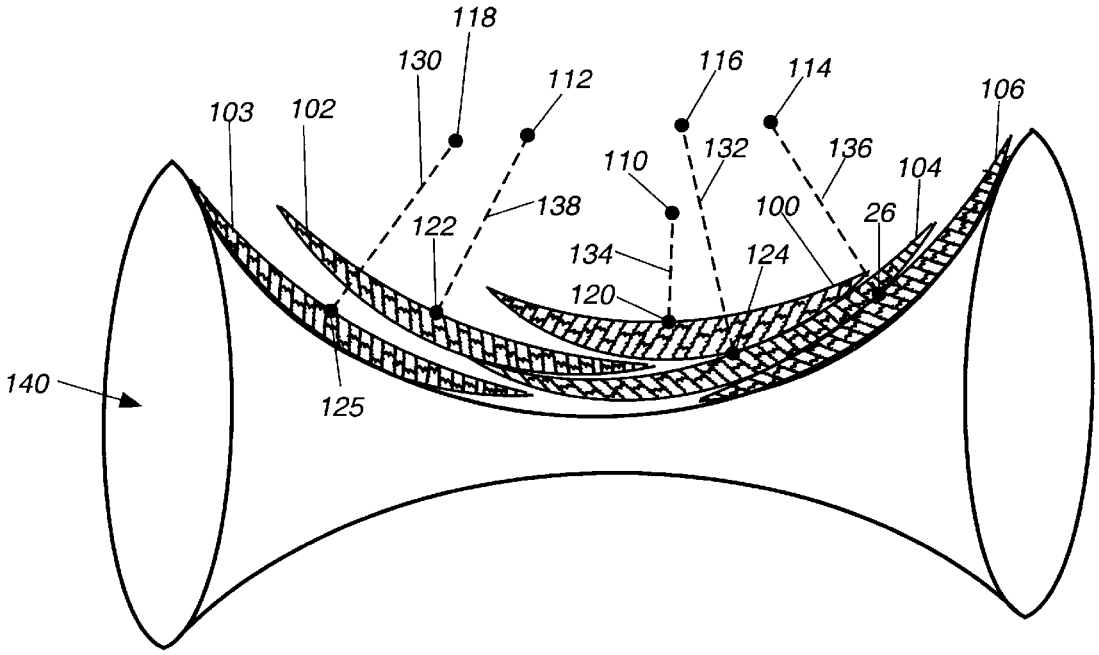
FIG. 2 is a side plane view of a second embodiment of the invention.

For the second embodiment of the invention shown in FIG. 2, the reflecting structures 100–108 have focal points 110–118 and centers 120–128 respectively. The reflecting structures 100–108 only partially overlap such that the focal points 112–118 and the centers 120–128 of the reflecting structures 100–108 do not align. Each reflecting structure 100–108 will generate an antenna pattern which will be located in a direction defined by the focal axis 130–138 of the corresponding reflecting structure 100–108 which generated that antenna pattern respectively. In this way, a single apparatus 140 can provide multiple communication links to communication stations or vehicles where the stations or vehicles are not co-located.

Referring back to FIG. 1, a plurality of radiating means 46–54 are located at the plurality of focal points 24–32. The first radiating means 46 is located at the first focal point 24, the second radiating means 48 is located at the second focal point 26, the third radiating means 50 is located at the third focal point 28, the fourth radiating means 52 is located at the fourth focal point 30; and, the nth radiating means 54 is located at the nth focal point 32. The radiating means 46–52 can be feed horns, crossed log-periodic dipole arrays, or the like. These radiating means 46–52 radiate a plurality of RF signals, each RF signal having a different frequency of operation or a different polarization. The first radiating means 46 radiates a first RF signal, the second radiating means 48 radiates a second RF signal, the third radiating means 50 radiates a third RF signal, the fourth radiating means 52 radiates a fourth RF signal and the nth radiating means 54 radiating an nth RF signal.

The first RF signal is incident upon the first reflecting structure 12. The first reflecting structure 12 is configured to reflect the first RF signal and redirect it in a direction parallel to the first focal axis 34 to generate a first antenna pattern. The first reflecting structure 12 is also configured to pass the second, third, fourth and nth RF signals.

The second RF signal is incident upon the second reflecting structure 14. The second reflecting structure 14 is configured to reflect the second RF signal and redirect it in a direction parallel to the second focal axis, back through the first reflecting structure 12 to generate a second antenna pattern.

The third, fourth and nth RF signals pass through the second reflecting structure. The third reflecting structure 16 is configured to pass the fourth and nth RF signals but reflect the third RF signal. The third reflecting structure 16 redirects the third RF signal in a direction parallel to the third focal axis, back through the first 12 and second 14 reflecting structures, and generates a third antenna pattern. The fourth and nth RF signals pass through the third reflecting structure 16.

The fourth reflecting structure 18 is configured to pass the nth RF signal but reflect the fourth RF signal. The fourth reflecting structure 18 redirects the fourth RF signal in a direction parallel to the fourth focal axis, through the first 12, second 14 and third 16 reflecting structures, and generates a fourth antenna pattern. The nth RF signal passes through the fourth reflecting structure and is incident upon the nth reflecting structure 20.

The nth reflecting structure 20 redirects the nth RF signal in a direction parallel to the nth focal axes and through all previous reflecting structures generating an nth antenna pattern.

For one embodiment of the invention, the first RF signal operates over a first frequency band, the second RF signal operates over a second frequency band, the third RF signal operates over a third frequency band, the fourth RF signal operates over a fourth frequency band and the nth RF signal operates over an nth frequency band. The frequency bands do not overlap in frequency. For this embodiment, all the reflecting structures except the nth reflecting structure are frequency selective structures. The nth structure does not pass RF signals; therefore, it can be fabricated of graphite, aluminum, RF reflecting elastic mesh or the like.

For an alternative embodiment of the invention, some of the reflecting structures are frequency selective structures whereas others are polarization sensitive structures. The polarization sensitive structures pass signals of one polarization and reflect signals of another polarization. Typically, a polarization sensitive structure will either pass horizontally polarized signals and reflect vertically polarized signals, pass vertically polarized signals and reflect horizontally polarized signals, pass right hand circularly polarized signals and reflect left hand circularly polarized signals or pass left hand circularly polarized signals and reflect right hand circularly polarized signals. In this way, two radiating means can operate over the same frequency range and still provide separate antenna patterns.

Figure 3:
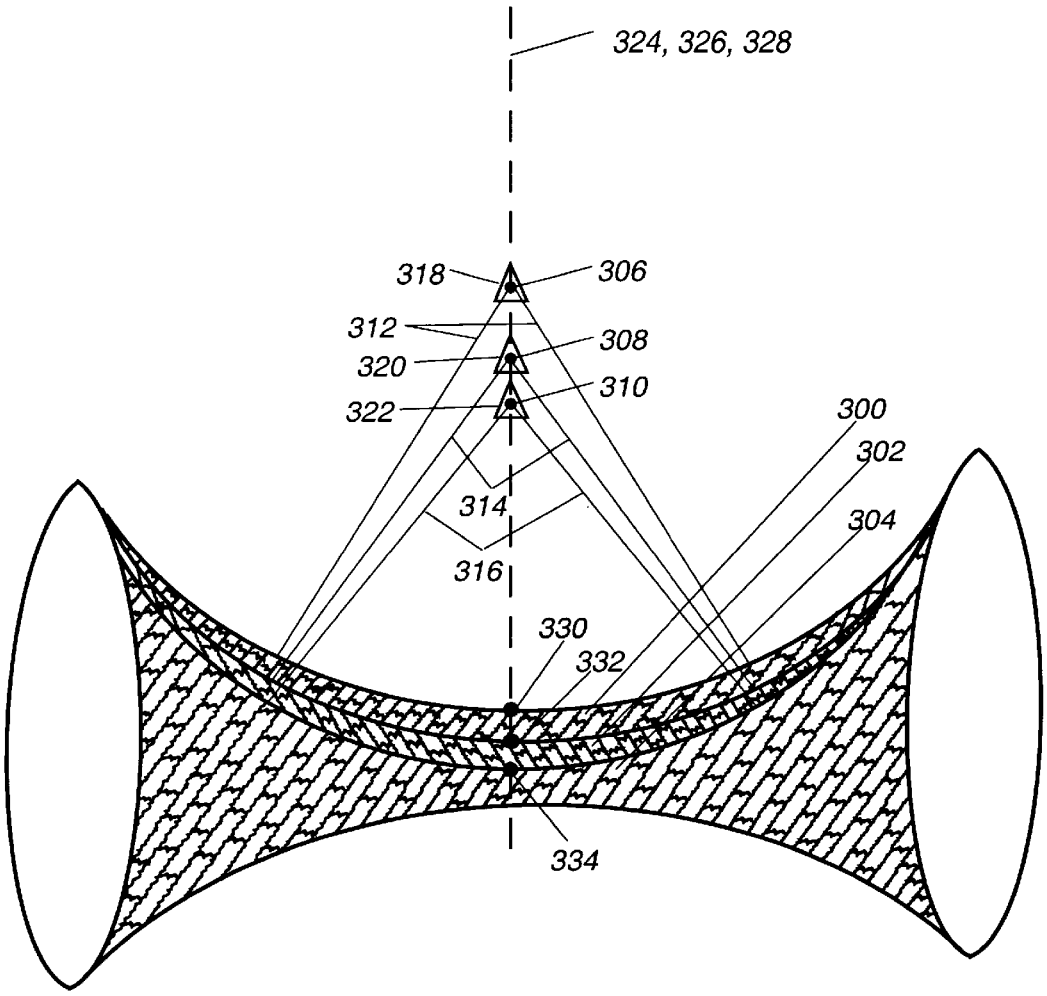
FIG. 3 is a side plane view of a third embodiment of the invention.

Referring to FIG. 3 for a third embodiment of the invention which combines frequency selective structures and polarization sensitive structures in a single support structure, the first reflecting structure 300 is a frequency selective structure configured to pass high and midband RF signals and reflect lowband RF signals. The second reflecting structure 302 is a polarization sensitive structure configured to pass all vertically polarized signals but reflect all horizontally polarized signals. The third reflecting structure 304 is a reflecting structure configured to reflect all RF signals regardless of their frequency or polarization.

The first focal axis 324 of the first reflecting structure 300 is defined by an imaginary line passing through the center 330 of the first reflecting structure 300 and extending through the first focal point 306. The second focal axis 326 of the second reflecting structure 302 is defined by an imaginary line passing through the center 332 of the second reflecting structure 302 and extending through the second focal point 308. And, the third focal axis 328 of the third reflecting structure 304 is defined by an imaginary line passing through the center 334 of the third reflecting structure 304 and extending through the third focal point 310. For the embodiment of the invention shown in FIG. 3, the centers 330–334 and the focal points 306–310 all lie along the same imaginary line such that all focal axis 324,326 and 328 align.

The first radiating means 318, located at the first focal point 306, radiates a first RF signal, depicted by lines marked 312. The first RF signal 312 is a lowband signal and is incident upon the first reflecting structure 300 which redirects the first RF signal 312 in a direction parallel to the first focal axis 324 generating a first antenna pattern.

The second radiating means 320 is located at the second focal point 308 and radiates a second RF signal, depicted by the lines marked 314. The second RF signal 314 has a highband frequency of operation and is horizontally polarized. Since the first reflecting structure 300 passes highband frequencies, the second RF signal 314 passes through the first reflecting structure 300 and is incident on the second reflecting structure 302 which is configured to pass vertically polarized signals but reflect horizontally polarized signals. The second reflecting structure 302 redirects the second RF signal 314 in a direction parallel to the second focal axis 326 and back through the first reflecting structure 300 generating a second antenna pattern.

The third radiating means 322 is located at the third focal point 310 and radiates a third RF signal, depicted by the lines marked 316. The third RF signal 316 also has a highband frequency of operation but is vertically polarized. The third RF signal 316 passes through the first reflecting structure 300 because the first reflecting structure 300 is a frequency selective structure configured to pass highband signals. The third RF signal 316 also passes through the second reflecting structure 302 since the second reflecting structure 302 is configured to pass all vertically polarized signals. The third RF signal 316 is then incident on the third reflecting structure 304 which redirects the third RF signal 316 in a direction parallel to the third focal axis 328. The third RF signal 316 passes back through the first 300 and second 302 reflecting structures and a third antenna pattern is generated.

Figure 4:
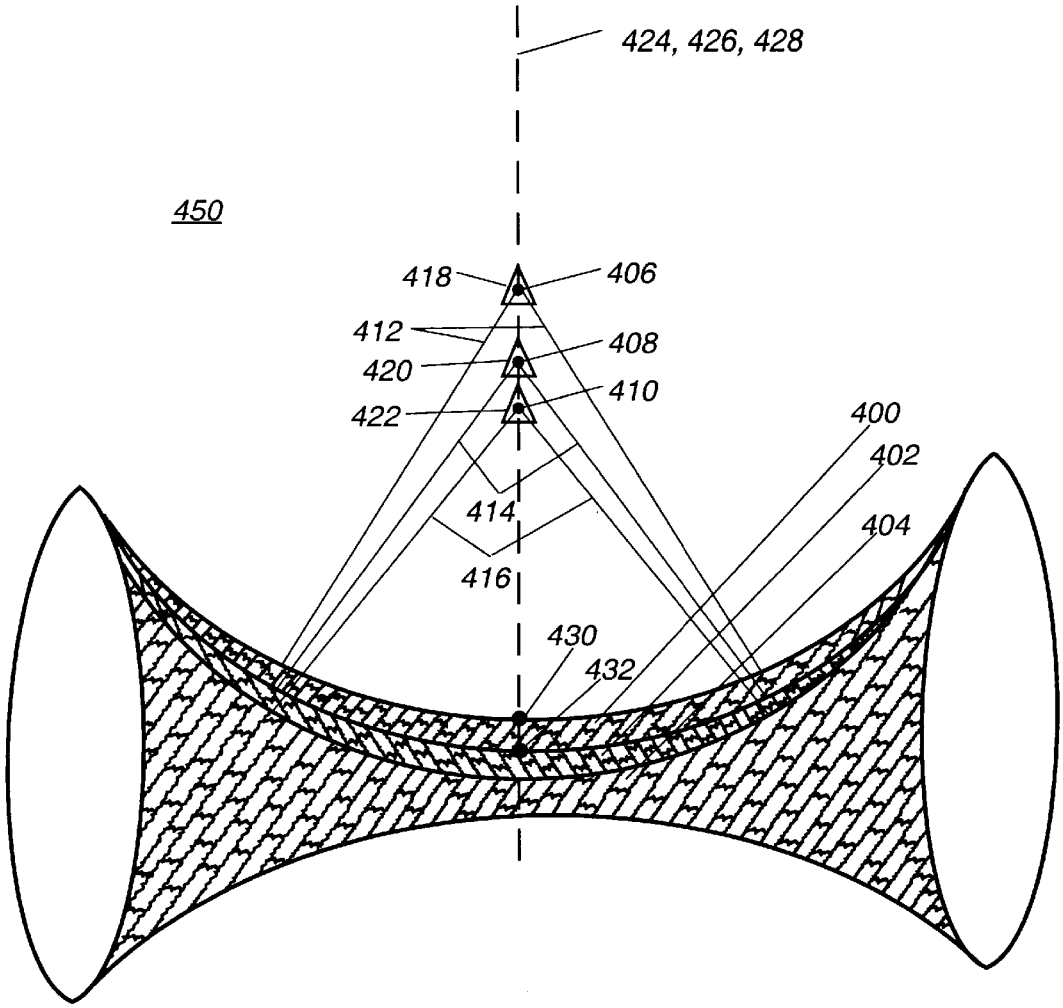
FIG. 4 is a side plane view of the preferred embodiment of the invention.

Referring to FIG. 4, for the preferred embodiment of the invention, the multi-focus reflector antenna 450 is a deployable antenna having a first 400, a second 402 and a third 404 deployable reflecting structure. The first 400, second 402 and third 404 reflecting structures are in the form of first, second and third paraboloids of revolution, each paraboloid of revolution being distinct. The first 400, reflective structure comprises a first elastic material; the second reflective structure 402 comprises a second elastic material; and, the third reflective structure 404 comprises a third elastic material. The first 400, second 402 and third 406 reflecting structures have first 406, second 408 and third 410 focal points respectively. The first reflecting structure 400 covers the second reflecting structure 402 which in turn covers the third reflecting structure 404. The first reflecting structure 400 is configured to reflect lowband RF signals and pass mid and highband RF signals. The second reflecting structure 402 is configured to reflect midband RF signals and pass highband signals. The third reflecting structure 404 is configured to reflect highband signals. The lowband, midband and highband signals being distinct frequency bands.

The first focal axis 424 of the first reflecting structure 400 is defined by an imaginary line passing through the center 430 of the first reflecting structure 400 and extending through the first focal point 406. The second focal axis 426 of the second reflecting structure 402 is defined by an imaginary line passing through the center 432 of the second reflecting structure 402 and extending through the second focal point 408. And, the third focal axis 428 of the third reflecting structure 404 is defined by an imaginary line passing through the center 434 of the third reflecting structure 304 and extending through the third focal point 410. For the embodiment of the invention shown in FIG. 4, the centers 430–434 and the focal points 406–410 all lie along the same imaginary line such that all focal axis 424,426 and 428 align.

For this embodiment, a first 418, a second 420 and a third 422 radiating means is placed at the first 406, second 408 and third 410 focal points respectively. The first radiating means 418 radiates a first RF signal, depicted by the lines marked 412, which is a lowband signal. The second radiating means 420 radiates a second RF signal, depicted by the lines marked 414, which is a midband signal. The third radiating means 422 radiates a third RF signal, depicted by the lines marked 416, which is a highband signal.

The first reflecting structure 400 is configured to pass mid and highband signals but to reflect lowband signals such that the first reflecting structure 400 redirects the first RF signal 412 in a direction parallel to the first focal axis 424 and generates a-first antenna pattern in the direction defined by the first focal axis 424. The second RF signal 414 is a midband signal which passes through the first reflecting structure 400 and is incident on the second reflecting structure 402. The second reflecting structure 402 is configured to pass highband signals but reflect midband signals such that the second reflecting structure 402 redirects the second RF signal 414 in a direction parallel to the second focal axis 426, through the first reflecting structure 400, to form a second antenna pattern in a direction defined by the second focal axis 426. The third RF signal 416 is a highband signal which passes through the first 400 and second 402 reflecting structures and is incident on the third reflecting structure 404. The third reflecting structure 404 is configured to reflect highband signals such that the third reflecting structure 404 redirects the third RF signal 416 in a direction parallel the third focal axis 428 to generate a third antenna pattern in a direction defined by the third focal axis 428.

Referring back to FIG. 2, for this embodiment of the invention, the plurality of reflecting structures only partially overlap. Therefore, only the portion of a reflecting structure which overlaps another reflecting structure is required to be a frequency selective or polarization sensitive structure.

For another embodiment of the invention, the plurality of reflecting structures are shaped structures which provide shaped antenna patterns. Further, for another embodiment of the invention, shaped and parabolic reflecting structure are both used in a single structure.

The multi-focus reflector antenna utilizes a preselected plurality of frequency selective and/or polarization sensitive reflecting structures to provide a single reflector structure having multiple focal points thereby overcoming the limitation of a typical reflector antenna. Using the multi-focus reflector enables a single reflector structure to replace multiple reflector antennas in a communications system saving weight, cost and space.

We claim as our invention:

1. An antenna comprising:

a support having a plurality of reflecting structures, said plurality of reflecting structures having a plurality of focal axes, each of said reflecting structures at least partially overlapping another one of said reflecting structures, the overlapping portion of one reflecting structure being frequency selective;

a plurality of radiating means radiating a plurality of RF signals, at least one of said plurality of RF signals passing through at least one of said plurality of reflecting structures and incident upon another of said plurality of reflecting structures, said plurality of reflecting structures directing said plurality of RF signals along said plurality of focal axes and generating a plurality of antenna patterns.

2. An antenna in accordance with claim 1 wherein said plurality of reflecting structures are deployable.

3. An antenna in accordance with claim 1 wherein said plurality of reflecting structures are a plurality of concave reflectors each being in the form of a paraboloid of revolution.

4. An antenna in accordance with claim 1 wherein said plurality of focal axes align.

5. An antenna in accordance with claim 1 wherein said plurality of focal axes align and said plurality of reflecting structures are completely overlapping.

6. An antenna in accordance with claim 1 wherein at least one of said plurality of reflecting structures is a polarization sensitive structure.

7. An antenna in accordance with claim 1 wherein at least one of said plurality of reflecting structures is a frequency selective structure.

8. An antenna in accordance with claim 1 wherein at least one of said plurality of reflecting structures is a frequency selective structure and at least one of said plurality of reflecting structures is a polarization sensitive structure.

9. An antenna comprising:

a first reflecting structure having a first focal point, and a first focal axis;

a second reflecting structure having a second focal point and a second focal axis;

a third reflecting structure having a third focal point and a third focal axis, one of said first and second reflecting structures overlapping a portion of another one of the reflecting structures, the overlapping portion being frequency selective;

a first radiating means located at said first focal point, said first radiating means radiating a first RF signal, said first RF signal incident upon said first reflecting structure;

a second radiating means located at said second focal point, said second radiating means radiating a second RF signal, said second RF signal passing through said overlapping portion of said first reflecting structure and incident upon said second reflecting structure;

a third radiating means located at said third focal point, said third radiating means radiating a third RF signal, said third RF signal passing through said overlapping portion of said first reflecting structure and said overlapping portion of said second reflecting structure and incident upon said third reflecting structure, said first reflecting structure directing said first RF signal along said first focal axis and generating a first antenna pattern, said second reflecting structure directing said second RF signal along said second focal axis and through said overlapping portion of said first reflecting structure generating a second antenna pattern, said third reflecting structure directing said third RF signal along said third focal axis and through said overlapping portion of said second reflecting structure and through said overlapping portion of said first reflecting structure and generating a third antenna pattern.

10. An antenna in accordance with claim 9 wherein said first reflecting structure is a first deployable reflector, said second reflecting structure is a second deployable reflector and said third reflecting structure is a third deployable reflector.

11. An antenna in accordance with claim 9 wherein said first reflecting structure comprises a first elastic material, said second reflecting structure comprises a second elastic material and said third reflecting structure comprises a third elastic material.

12. An antenna in accordance with claim 9 wherein said first reflecting structure is in the form of a first paraboloid of revolution, said second reflecting structure is in the form of a second paraboloid of revolution, said third reflecting structure is in the form of a third paraboloid of revolution, said first, second and third paraboloids of revolution being distinct.

13. An antenna in accordance with claim 9 wherein said first RF signal is a low band signal, said second RF signal is a midband signal and said third RF signal is a highband signal, said lowband, midband and highband signals being distinct frequency bands.

14. An antenna in accordance with claim 9 wherein said first focal axis, said second focal axis and said third focal axis align with respect to each other.

15. An antenna in accordance with claim 9 wherein said second reflecting structure completely overlaps said first reflecting structure and said third reflecting structure completely overlaps said second reflecting structure.

16. An antenna in accordance with claim 9 wherein said first reflecting structure is a polarization sensitive structure and said second reflecting structure is a polarization sensitive structure.

* * * * *